United States Patent [19]

Dryden

[11] 3,986,682

[45] Oct. 19, 1976

[54] IBIS GUIDANCE AND CONTROL SYSTEM

[75] Inventor: Eugene H. Dryden, San Marino, Calif.

[73] Assignee: The United States of America as represented by the Secretary of the Navy, Washington, D.C.

[22] Filed: Sept. 17, 1974

[21] Appl. No.: 506,500

[52] U.S. Cl. ..... 244/3.17; 343/5 MM

[51] Int. Cl.[2] ..... F41G 7/00

[58] Field of Search ..... 244/3.17, 3.15, 3.16, 244/3.18; 250/203 R; 343/5 MM; 102/70.2 P

[56] References Cited

UNITED STATES PATENTS

| | | | |
|---|---|---|---|
| 3,376,411 | 4/1968 | Montani et al. | 244/3.17 |
| 3,416,752 | 12/1968 | Hembree | 244/3.17 |
| 3,837,733 | 9/1974 | Shoch et al. | 244/3.17 |

*Primary Examiner*—Samuel Feinberg

[57] ABSTRACT

A guidance system for automatically boresighting a small field-of-view, low-resolution image, sensed by an infrared missile imaging sensor, to a large field-of-view, high-resolution image, sensed by an imaging sensor located within an airplane. The image sensed by each sensor is applied to a digital correlator which makes a bit-by-bit digital correlation of the images. The image sensed by the large field-of-view aircraft sensor is monitored on a CRT. Cross-hairs are placed at the centerpoint of the area in the monitored aircraft sensor image which has the highest correlation with the missile sensor image. Thus the boresight of the missile sensor is ostensibly located in the monitored, aircraft, sensor image.

This system may be used to slave automatically one sensor boresight to another. Where a plurality of missiles are carried by one plane, the boresight of each missile may be located in the large field-of-view aircraft monitor.

16 Claims, 5 Drawing Figures

FIG. 2
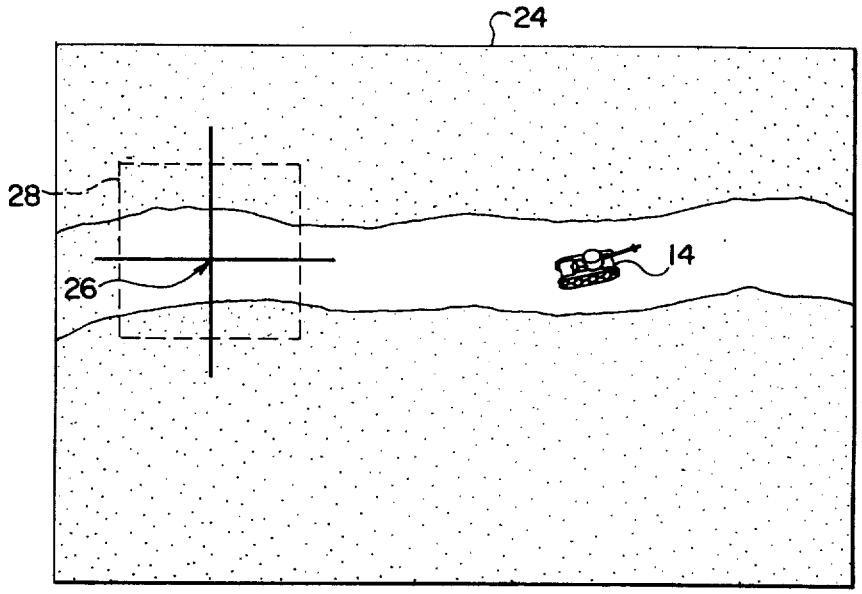
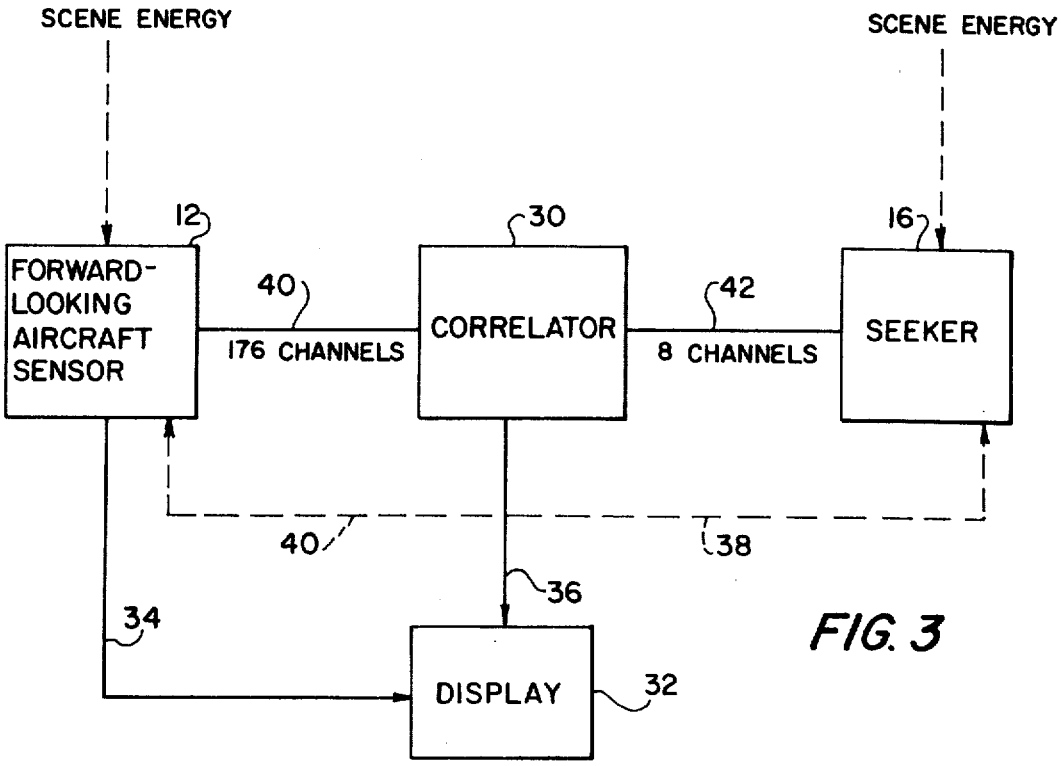
FIG. 3

IBIS GUIDANCE AND CONTROL SYSTEM

FIELD OF INVENTION

This invention relates generally to radar systems and in particular to air-to-surface missile guidance systems.

PRIOR ART

Most missile guidance systems use passive seekers located in the missile nose for locking on a target. Passive seekers generally employ a camera for sensing the radiation reflected from the ground. To-date laser, electro-optical, and infrared cameras have been used in missile seekers.

The seeker camera is usually monitored on a scope in the aircraft by the pilot before missile firing. When the pilot locates the target, he maneuvers the plane so that the target is within the reticle of the seeker camera. The pilot must then give a manual lock-on command followed by a missile release command.

Upon missile launch, the seeker guidance system takes over. Either a variable-size tracking gate or a correlation system for correlating the present seeker camera image to a reference contrast pattern may be used to control the missile servos and thus guide the missile to its target.

A major disadvantage of this type of system is that a high quality, high resolution, wide field-of-view seeker camera must be used in order to allow the pilot sufficient time (1) to recognize the target and (2) to react so as to maneuver the aircraft so that the target is within the seeker camera reticle before the plane passes over the target. This design requirement leads to a very expensive seeker system for each missile.

Attempts have been made in the past to use seeker systems with just adequate resolution and field-of-view properties. This trade-off of resolution and field-of-view for a lower production cost leads to a high aircraft attrition rate. This is because with a small field-of-view it is much more difficult for the pilot to pick out a target from its background. This problem is compounded when a low resolution system is used. Since more time is needed to pick out the target and lock on it, in any situation where the enemy has an up-to-date antiaircraft defense, there will be a high aircraft attrition rate.

Thus there is a major need in present weapon guidance technology for a low cost, air-to-surface, guidance system having sufficient resolution and field-of-view to allow pilot to pick out a target against a cluttered background at sufficient ranges to minimize aircraft attrition through evasive maneuvers.

A second major problem with prior art systems is that only one missile seeker camera may be monitored by the pilot at a time. Thus, where an aircraft is carrying more than one missile and there are two targets in close proximity to each other, the pilot is frequently forced to make another pass over the second target. This procedure also leads to a high aircraft attrition rate.

SUMMARY OF THE INVENTION

These guidance system problems are resolved in the present invention by providing a small field-of-view, low resolution, forward-looking missile seeker camera, a second forward-looking camera mounted in the aircraft with a large field-of-view, a high resolution monitoring system for displaying the second camera's large field-of-image to the pilot, and a digital cross-correlator for locating the small field-of-view of the missile camera within the aircraft camera's large field-of-view and displaying this location on the monitor.

In this system, since the main monitoring camera is located in the aircraft as opposed to the expendable missile, a much larger field-of-view, high resolution system is economically feasible. Thus the pilot may begin to monitor the target at much longer ranges, thus giving ample time for target recognition, lock-on, and the initiation of evasive maneuvers. Since the camera scene correlation is done electronically, no human recognition factors need be taken into account. Thus a very small field-of-view, low-resolution, seeker camera may be used. A desired cost reduction is thereby accomplished by minimizing the complexity of the expendable missile seeker at the expense of the aircraft mounted equipment.

Since the aircraft camera's field-of-view encompasses a large area, a number of small missile camera fields-of-view may be located on the main aircraft monitor simultaneously, thus removing the second pass requirement when targets are in close proximity.

OBJECTS OF THE INVENTION

An object of the present invention is to reduce the cost of missile-seeker system.

A further object of the present invention is to increase the time the pilot has for target recognition.

A still further object is to monitor the fields-of-view of a plurality of missile seekers simultaneously.

A still further object is to increase the field-of-view and resolution of the scene that a pilot actually monitors while decreasing the cost of the over-all system.

A still further object is to decrease the aircraft attrition rate while target boresighting by increasing the range at which boresighting may be accomplished.

Other objects, advantages, and novel features of the present invention will become apparent from the following detailed description of the invention when considered in conjunction with the accompanying drawings.

BRIEF DESCRIPTION OF THE DRAWINGS

FIG. 2 is a diagram showing an actual monitored image that the pilot might see when the present invention is implemented.

FIG. 3 is a block diagram of boresighting system of the present invention.

DETAILED DESCRIPTION OF THE INVENTION

Figure 1:
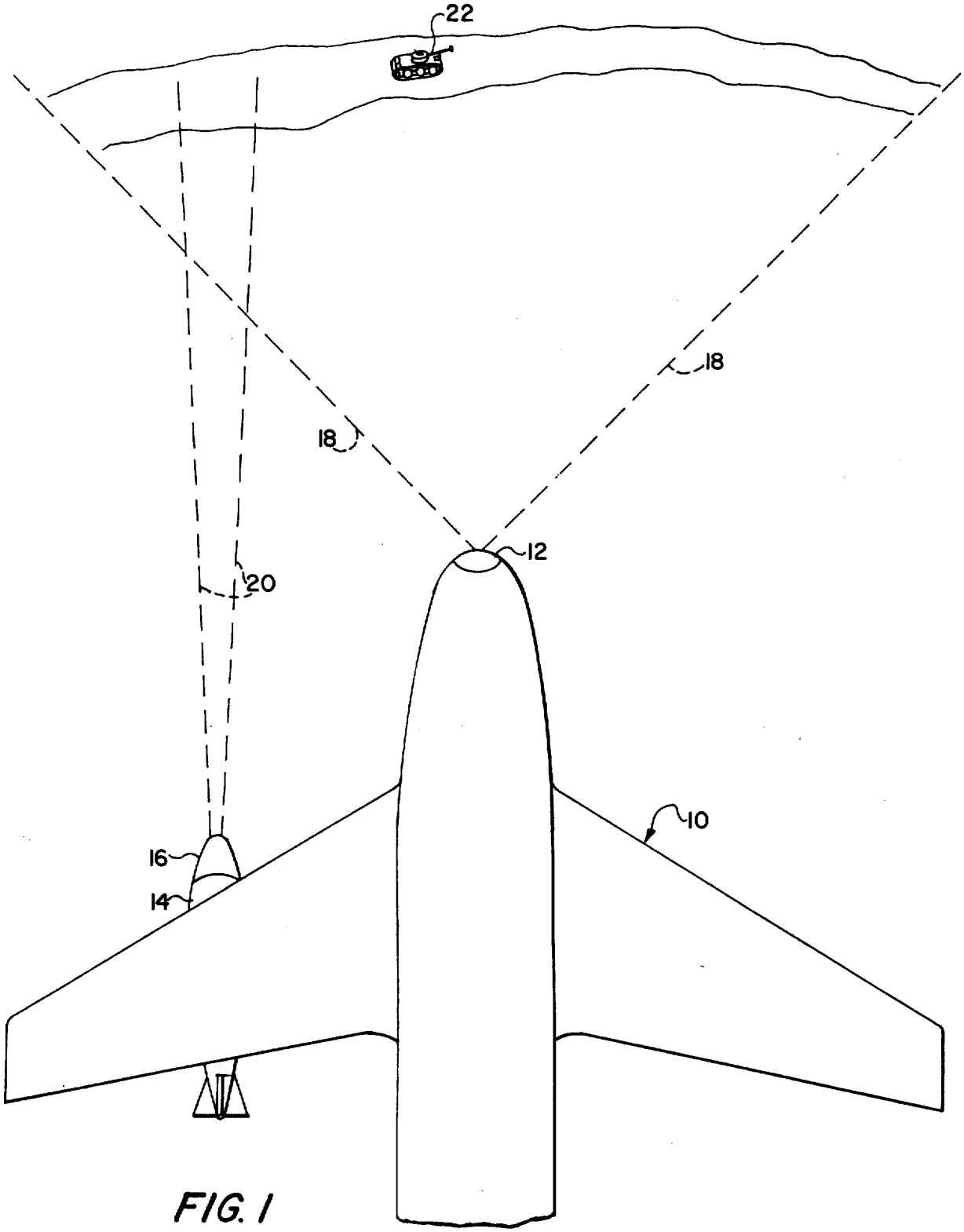
FIG. 1 is a schematic diagram of a typical field-of-view placement of the mixxile and aircraft sensors.

FIG. 1 illustrates a typical field-of-view placement in the basic system of this invention. The aircraft 10 has a wide field-of-view, high resolution camera 12 located in its nose. Its field-of-view 18 is shown encompassing the target 22. A missile 14, slung beneath the wing of the aircraft 10, has a seeker camera system 16 located in its nose. The seeker field-of-view is shown as the dashed lines 20.

As can be seen from the drawing, the seeker system field-of-view 20 does not encompass the target 22. Thus the pilot must maneuver his aircraft to place the target within the seeker field-of-view.

FIG. 2 shows the actual monitored image that the pilot sees. The large box 24 is the high-resolution, aircraft cameras, sensed-energy image of the scene. The dashed line box 28 represents the image that the missile seeker camera 16 is sensing. The lines 26 represent the missile-seeker crosshairs which must be placed over the target before the pilot may initiate the standard lock-on procedure. It should be understood that only the crosshairs of the seeker show up on the scope monitor 24.

A block diagram of the basic system is shown in FIG. 3. The missile sensor, or seeker, for sensing the scene energy is the block 16. In the actual embodiment developed, the sensor consists of infrared detectors (Ge: Hg or (Hg-Cd)Te), although it is to be understood that any energy-sensing detector over any frequency range could be used. Since human monitoring of the seeker image is not essential in this system, the seeker is designed to have only sufficient image quality and field-of-view to meet area correlation requirements with the aircraft sensor 12. Thus only 8 infrared detectors taking 16 samples per line, thus providing 128 resolution elements, need be used. These detectors are arranged to cover a 1° by 1° field-of-view. A 1 milli-radian resolution may be used. A seeker with these parameters is the Aerojet Model T77 Seeker. This seeker has 8 detector channels taking 16 samples per line thus providing an 8 × 16 image matrix. The seeker further has a rectilinear scan at 60 fields per second scan rate using a 2.1 interlace.

The aircraft scene sensor 12 is a forward-looking infrared sensor. Again it is to be understood that any type of energy sensor over any frequency range could be used. The actual sensor used is the Aerojet Model C19N FLIR. The FLIR (Forward Looking Infrared sensor) has a dual field-of-view capability; a wide field (20° elevation by 25° azimuth) for acquisition and a narrow field (5° elevation by 6.25° azimuth) for high resolution. Its resolution is 1 milli-radian for the wide field and 0.25 milli-radians for the narrow field. The FLIR has 176 detector channels with 65 samples (resolution elements) taken from each detector, thus providing a 176 × 64 image matrix. The detectors used as Ge:Hg detectors. The correlator 30 is a digital cross-correlator. It receives both the sensor 12 and the seeker 16 scene video outputs, processes the video outputs for digitized storage, and compares the scenes bit-by-bit for effecting an area correlation.

In order to allow the use of straightforward, digital, processing techniques in the area correlator there are certain compatibility requirements between the seeker 16 and the aircraft sensor 12. First, in order to avoid the need for elaborate scan conversions in the correlator, the seeker scan pattern must have approximately the same characteristics as the aircraft sensor scan pattern. Second, it has been determined that approximately 100 resolution elements are required to generate an adequate cross-correlation function between two pictures while maintaining adequately low sidelobe amplitudes. Thus the seeker 16 must have at least 100 resolution elements for each scene. Third, only elements of approximately the same resolution may be correlated.

The display 32 provides a means for viewing the large field-of-view aircraft sensor image. The section in this image that correlates with the seeker image is distinguished by displaying a set of crosshairs at the section center in the well known manner. This display 16 may consist of a conventional cathode-ray-tube monitor with high resolution and high dynamic range for optimization of the display/human eye interface.

In operation, the large field-of-view (20° elevation by 25° azimuth) of the aircraft sensor 12 initially provides a sufficiently large scene which can be examined at low resolution for examination for potential targets. This scene is viewed by the aircraft crew via line 34 on display 32. When a potential target has been determined, a high-resolution narrow field-of-view (5° elevation by 6.25° azimuth) is used for examination on the display 36 and designation of the target to be attacked.

At this time the correlator 30 is switched on, as is the missile seeker 16. The correlator 30 digitally processes the scenes from the aircraft sensor 12 (5° by 6.25° field-of-view) and the seeker 16 (1° by 1° field-of-view) and digitally compares these scenes bit-by-bit. When correlation has been accomplished, a boresight error signal (difference between the aircraft sensor crosshair coordinates and the seeker crosshair coordinates) is sent via line 36 to the display 32. This error signal is used to locate the seeker crosshairs within the air-craft sensor scene being displayed on the display 32.

Thus the pilot of the aircraft using this display may maneuver the plane or change the gimbal positions of the seeker detectors such that the target is under the seeker crosshairs.

Alternately, a seeker-aircraft sensor slaving mode of operation could be used. If seeker-to-aircraft sensor slaving is desired, the boresight error may be applied via line 38 to the seeker 16 to activate the seeker's servo system to reposition the seeker detector gimbals so that the seeker field-of-view is centered on the aircraft-sensor crosshairs. If the aircraft sensor is desired to be slaved to the seeker 16, the boresight error is merely applied via line 40 to the aircraft sensor servos. Activation of these servos causes the repositioning of the aircraft sensor crosshairs to the seeker field-of-view crosshairs. Activation of gimbal servo systems for repositioning is well-known in the art and thus will not be discussed further.

Figure 4:
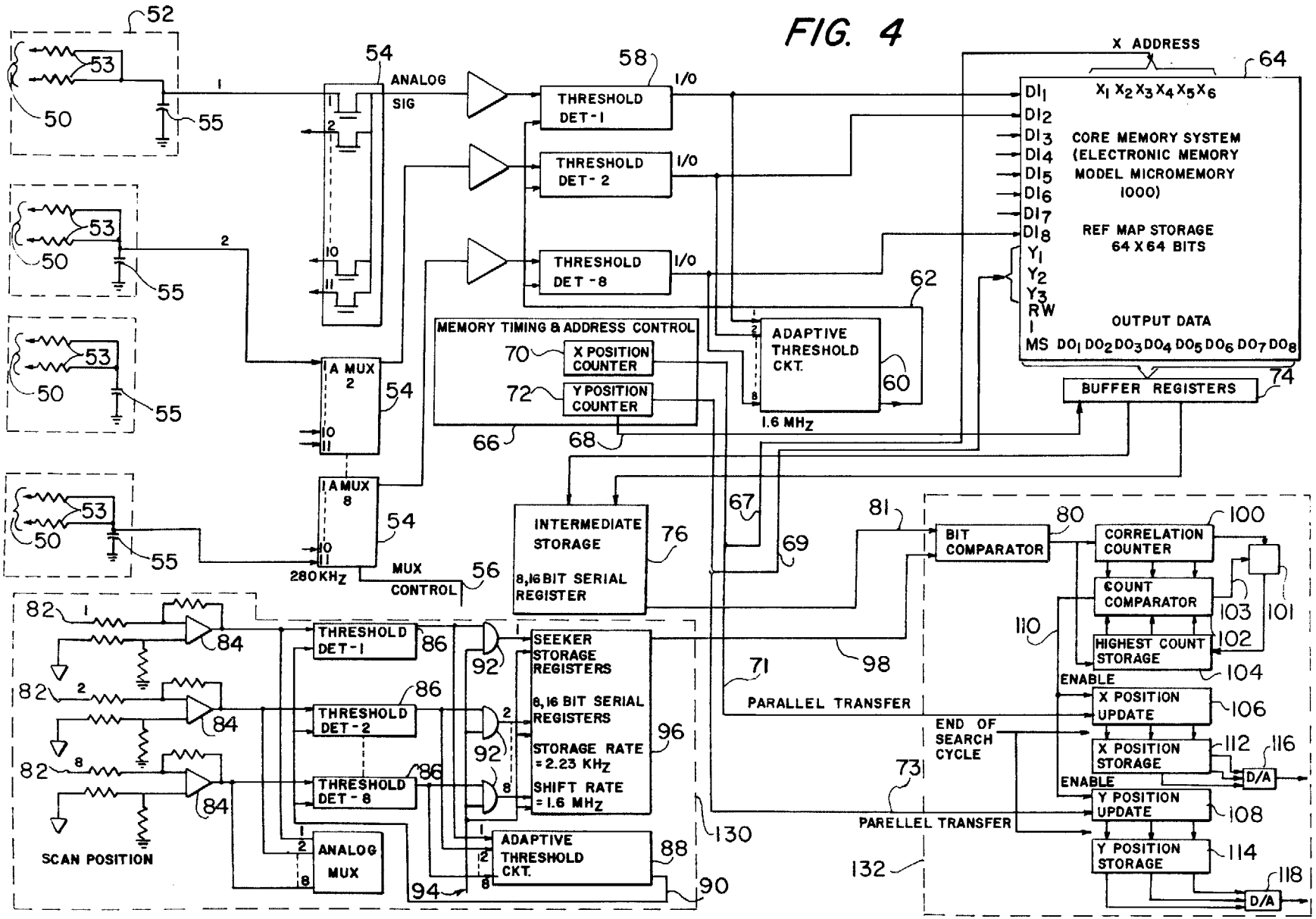
FIG. 4 is a block diagram of a correlator that could be used in the present invention.

A cross-correlation system that may be used in the present system is shown in FIG. 4. The aircraft sensor inputs from the 176 detector channels are shown as the numbered lines 50.

The initial 176 detectors (64 samples per detector) have a ¼ mr resolution. In order to make the sensor 12 resolution compatible with the seeker 16 resolution (1 mr), the technique of averaging adjacent detector channels is used. This produces an approximately 1 mr resolution in the vertical direction. In FIG. 4 this averaging is accomplished by adding adjacent channels through the resistors 53 in network 52. These averaged channels are then filtered using the capacitor 55 in a low pass filter configuration to match the sensor 12 resolution exactly to the seeker 16 resolution.

After this averaging, there are 88 channels forming an 88 × 64 matrix.

Generally some type type of multiplexing is required before this data may be stored in a core memory. The particular type of multiplexing required depends on the core memory used. In the actual embodiment developed, an 8 plane (*i* bit) core memory is used. Thus 8 inputs are possible at a time. In order to handle the 88 channels, 8 multiplexers 54 with 11 inputs each are provided. Each multiplexer 54 essentially comprises 11 field-effect-transistor switches. One switch in each multiplexer is biased on such that 8 channel inputs are being applied to the memory at any one time. After a short time interval, the next field effect transistor in the set of parallel multiplexers is biased on. Thus these channels are sampled 8-at-a-time, until all 88 channels have been sampled. The multiplexer switching is controlled by a timing control signal which is applied on line 56.

After multiplexing, each channel signal is applied to a threshold detector 58 which converts the signals to binary 1's and 0's. In order to obtain a proper correlation function, 50% of the picture elements must lie above the threshold and 50% must be below the threshold of the detector. This correlation requirement is met through the operation of a standard adaptive threshold circuit 60. This circuit 60 merely determines the mean level of the detector outputs using a set of comparing circuits and sets the threshold in the detectors 60 accordingly via line 62.

These 88 channel inputs are then applied to the magnetic core memory 64 for storage. As stated previously, this is a 64 × 64, 8-plane memory with a read/write, full-cycle time of 2.5 microseconds.

When each channel has been scanned to obtain 64 samples and this 88 × 64 element matrix representing the FLIR sensor image has been approximately sotred in memory 64, 8 × 16 blocks from this 88 × 64 matrix are systematically read-out and applied to a bit comparator 80 under control of a memory address and control timing circuit 66. These 8 × 16 blocks are taken from the 88 × 64 image array and compared in parallel to an 8 × 16 seeker image array in this comparator 80.

The seeker-correlator interface will now be discussed. The 8 seeker input signals 82 from the eight seeker detectors are applied to eight buffer amplifiers 84. The buffer amplifier outputs are digitized to 1's and 0's by eight parallel threshold detectors 86 (one for each channel). Again there is an adaptive threshold circuit 88 identical to the circuit 60 controlling the detector thresholds by means of the line 90. Each of these digitized seeker signals is applied as one input to a set of eight parallel AND gates 92. The second input 94 into each of these AND gates 92 is a timing signal for strobing the digitized signals into eight 16-bit shift registers 96.

The same timing signal 94 used to strobe the digitized signals is also used to gate one of the eight shift registers in block 96 to the output line 98. This output line 98 contributes an input to the bit comparator 80.

A counter 100 counts the number of digital matches of these two parallel inputs (one input representing the 8 × 16 block from the 88 × 64 matrix, one input representing the 8 × 16 element seeker image) into the bit comparator 80. The correlation number (number of matches) for each 8 × 16 block of the 88 × 64 array is applied to a count comparator 104 to compare it to a number in the highest count storage register 102. If this number in counter 100 is greater than the number held in the count storage 102, it is read into register 102 as the new highest count. The X and Y coordinates of this 8 × 16 block which has the new highest count are read into an X-position update register 106 and a Y-position update register 108 respectively. This process is discussed in detail at a later point.

The memory timing and address control circuit 66 is used to determine what section of the 88 × 64 aircraft sensor map is to be compared with the 8 × 16 seeker picture. Basically, the control circuit 66 reads out of the memory 64 an 8 × 16 element array and stores this 8 × 16 array in an intermediate storage register 76 (eight 16-bit shift registers). This 8 × 16 element array is then applied to a bit comparator 80 in parallel with an 8 × 16 seeker element array.

The actual method of systematically taking 8 × 16 blocks from the 88 × 64 matrix is merely a question of formating and can be done in any number of ways.

In this particular formating embodiment, 8-bit words must be processed since an 8-plane core memory is used for the memory 64.

Figure 5:
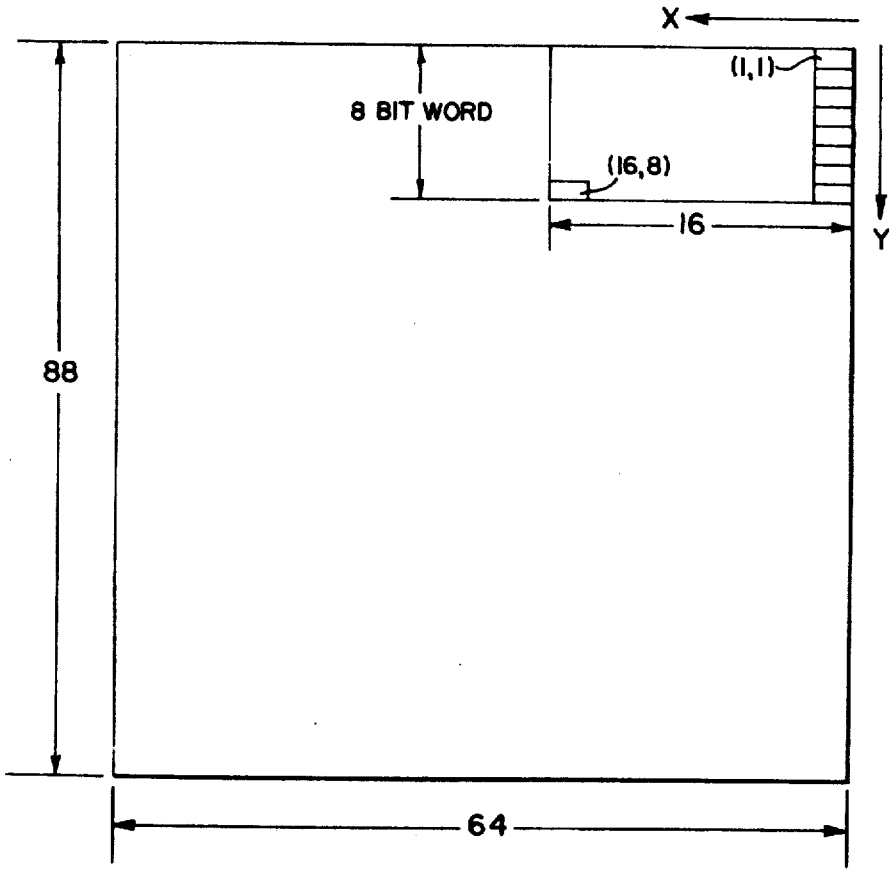
FIG. 5 is a schematic illustration of an 88 × 64 element array that may be used for the core memory.

FIG. 5 illustrates the formating technique used on the 88 × 64 matrix of the present embodiment. The memory 64 holds the 8-bit words in the Y-direction as shown in the figure. Obviously, problems will arise when an 8 × 16 array extends over two 8-bit words. For example, if an 8 × 16 array has an X boundary extending from 1 to 16 and a Y boundary extending from 2 to 9, two vertical 8-bit words must be used (the word holding elements 1 to 8 and the word holding elements 9–16) in order to obtain the 8 desired y elements.

In order to obtain the desired 8 elements, 2 consecutive vertical 8-bit words are read from the memory 64 and applied to a 16-bit buffer shift register 74. Eight of the flipflops of the 16-bit register 74 have outputs to the intermediate storage register 76. When the 16 bits from the two words have been shifted into the register 74, the timing control circuit 66 applies a set of pulses via line 68 to the register 74 to shift this register until the appropriate 8-bits of the 16-bit shift register are opposite the 8 output flipflops to the storage register 76. Thus in the example, the register 74 would be shifted once so that the bits 2 through 9 are opposite the 8 output flipflops in register 74. These 8-bits would then be applied to the intermediate storage 76 as one 8-bit row in the 8 × 16 array. Sixteen 8-bit rows would be read into the intermediate storage 76 in this fashion. When the complete 8 × 16 array is read into the storage 76, each element in the area is read out in parallel with an element from the seeker 8 × 16 array and digitally compared in the comparator 80.

The control circuit 66 consists of a set of two digital counters (a 64-bit X-position counter 70 and an 88-bit Y-position counter 72) and appropriate timing circuitry for operating the counters. The numbers held in these counters represent the X, Y coordinate position of the bottom element of the 8 bits that are to be taken from memory 64. For example if the array with a position bounded by $X = 1$ to 16 and $Y = 9$ is desired, the first number held in the counters will be $X = 1$, $Y = 9$. As stated previously, when this number is read into the memory 64 the two 8-bit words $X = 1$, $Y = 1$ to 8 and $X = 1$, $Y = 9$ to 16 are read into the buffer register 74 and appropriately shifted to obtain the 8-bits from $Y = 2$ to $Y = 9$.

The initial operation of this control system will now be described. The X counter 70 is set to 1 and the Y counter 72 is set to 8. These coordinate values are then applied to the X address and Y address in the memory 64 via lines 67 and 69 respectively. Thus these 8-bits ($X = 1$, $Y = 1$ to 8) are applied to the storage 76 as the first 8-bit column in the 8 × 16 array in the before-mentioned manner. The X-position counter 70 is then incremented by 1 and the next 8-bits are applied to the storage 76. Thus continues until 16 columns of 8-bits are stored in the storage 76. This 8-x 16 array is then compared in parallel fashion to the seeker 8 × 16 array and the number of digital matches in the comparator 80 are counted by the correlation counter 100. This correlation count is then compared in a comparator 102 with the number held in the highest count storage register 104. Initially this count in counter 104 is zero. The comparator 102 thus determines that the number held in the correlation counter 100 is greater and applies an enable signal to the gate 101 via line 103. The count held in counter 100 is thus read into the highest-count storage 102 as the new highest count.

It should be noted that the counters 70 and 72 always contain the address of the lower-most left element in the 8 × 16 array during the actual comparison process. Also it should be noted that the X-position counter 70 applies an input to the X-position update 106 via line 71 while the Y-position counter 72 applies an input to the Y-position update 108 via line 73. When the comparator 102 determines that there is a new highest count, it applies an enable signal via line 110 to the update registers 106 and 108. Thus the numbers held in the counters 70 and 72 are read into their respective update registers 106 and 108 as the coordinates of the lower left corner element of the 8 × 16 matrix with the new highest correlation count.

The intermediate storage 76 is set to retain the 8 × 16 array after the comparison process by connecting each element in the 8 storage registers of storage 76 for recirculation (feedback). Thus to compare the next 8 × 16 array ($X = 2$ to 17, $Y = 1$ to 8), the first row in the 8 × 16 array ($X = 1$, $Y = 1$ to 8) is shifted out of the storage register 76. Simultaneously the X-position counter 70 is incremented by 1 and this address ($X = 16 + 1$, $Y = 8$) is applied to the X and y memory addresses. Thus the 8-bits ($X = 17$, $Y = 1$ to 8) are read into the storage 76 in the before-mentioned manner to form the new 8 × 16 array. This new 8 × 16 array is compared accordingly. This process is repeated until the X-counter reaches the count 64. At this point the X-position counter 70 is set to 0 and the Y-position counter 72 is incremented by 1 to equal 9. This comparison process is continued until each 8 × 16 block in the 88 × 64 array is compared to the 8 × 16 seeker array.

It is reiterated that this particular method of formating is merely one of many that could have been used for memory storage and comparison.

When the 8 × 16 seeker array has been compared to every 8 × 16 block in the 88 × 64, aircraft, sensor image, the numbers held in the X and Y position update registers 106 and 108 are transferred into their respective position storage registers 112 and 114. These registers 112 and 114 serve as buffers for digital-to-analog converters 116 and 118 respectively. These D/A converters provide the analog boresight error that may be applied to either the CRT display and/or the servo systems of either the seeker or the aircraft sensor.

It should be noted that since the X–Y coordinates held in the registers 106 and 108 represent the lower-most left element in the 8 × 16 array, the D/A converters 116 and 118 must be offset by a certain amount to give the 8 × 16 array center (the actual seeker boresight). Thus the X coordinate must be offset by eight to give X center coordinate while the Y coordinate must be offset by four to give the Y center coordinate. The actual boresight error (difference between the 88 × 64 array center and the 8 × 16 array center being compared) is determined by subtracting the 8 × 16 center coordinates from the 88 × 64 center coordinates (44, 32).

As stated previously, a major advantage in addition to low seeker cost is that two or more seeker crosshairs may be displayed simultaneously on the high-resolution, large field-of-view aircraft sensor. This may be simply implemented merely by duplicating in the coorelator 30 the seeker interface section (dashed line box 130) and the comparison section (dashed line box 132) for each simultaneous seeker crosshair desired on the display. An input from the intermediate storage 76 via line 81 could be applied to each bit comparator 80 in the system. Each seeker crosshair would then be summed into the video signal in the well-known manner. Thus only one core memory 64 and 88 channel aircraft sensor interface is required, thus providing a considerable cost savings.

It is to be understood, of course, that the aircraft sensor servos cannot be slaved to the seeker boresight since there is now more than one seeker boresight.

Obviously, many modifications and variations of the present invention are possible in light of the above teachings. It is therefore to be understood that, within the scope of the appended claims, the invention may be practiced otherwise than as specifically described.

What is claimed is:

1. A guidance system for boresighting a small field-of-view imaging sensor to a large field-of-view sensor comprising:

first imaging sensor means with a field-of-view;

second imaging sensor means with a field-of-view substantially smaller than the field-of-view of said first imaging sensor means;

correlator means for determining the location of the second sensor field-of-view within the larger first sensor field-of-view by digitally comparing the array of elements forming the image sensed by said second sensor with equal size arrays taken from the larger field-of-view image developed by said first sensor means until the highest correlation area within this first sensor field-of-view has been determined, and then calculating the boresight error between the center point coordinates for the first sensor image and the center coordinates for this highest correlation area;

cathode-ray tube display means for displaying the image sensed by said first imaging sensor means and locating and placing the center crosshairs of said second imaging sensor means within this image.

2. An aircraft-missile guidance system for bore-sighting a small field-of-view missile sensor image to a large field-of-view aircraft sensor image comprising:

first imaging sensor means with a large field-of-view located in an aircraft;

second imaging sensor means with a much smaller field-of-view and low resolution relative to said first imaging sensor means located within a missile carried by the aircraft;

correlator means for determining the location of the second sensor field-of-view within the much larger first sensor field-of-view;

display means for displaying the first sensor image and for displaying the position where this second sensor image lies within this first sensor image.

3. An aircraft-missile boresighting system as in claim 2, wherein said correlator comprises means for calculating the boresight error between the two fields-of-view; and further comprising means for applying this calculated boresight error to the servo systems controlling the second imaging sensor gimbals for effectively slaving said second imaging sensor means to the boresight of said first imaging sensor means.

4. An aircraft-missile boresighting system as in claim 2, wherein said correlator comprises means for calculating the boresight error between the two fields-of-view; and further comprising means for applying this calculated boresight error to the servo systems controlling the first imaging sensor gimbals for effectively slaving said first imaging sensor means to the boresight of said second imaging sensor means.

5. An aircraft-missile boresighting system as in claim 2 wherein there are a plurality of missiles carried by said aircraft, each of said missiles containing said second imaging sensor means; and further wherein said correlator means comprises a separate interface for each of said plurality of missiles for processing their sensor images, and a separate comparing block for comparing each processed, missile-sensor image with the larger first sensor image and determining a boresight error to be applied to said display means so that the boresights of a number of said missile-imaging-sensor means may be indicated on said display means simultaneously.

6. An aircraft-missile horesighting system as in claim 5 wherein said separate interface for each of said plurality of missiles comprising a means for digitizing the image signals and a means for storing these digitized signals; and further wherein said separate comparing block for comparing each processed missile sensor image with the larger first sensor image comprises a bit comparator for comparing two parallel image inputs, and a counting means for determining the number of digital "matches" in said bit comparator and determining which area within the larger first sensor image which has the highest digital match number.

7. An aircraft-missile boresighting system as in claim 2 wherein said imaging sensors are infrared, imaging sensors.

8. An aircraft-missile boresighting system as in claim 2 wherein said correlator means is a digital cross-correlator comprising:

means for digitizing each element forming the images sensed by said imaging sensor means;

means for digitally comparing the array of elements forming the image sensed by said second sensor means with a set of equal sized arrays of elements taken from the larger image developed by said first imaging sensor means;

means for counting the number of digital matches determined by said comparison means for each individual array and determining the area in the first sensor means image which has the highest number of digital element matches with the second sensor means image.

9. An aircraft-missile boresighting system as in claim 8 wherein said correlation means further comprises means for calculating the boresight error between the centers of the two sensor images.

10. An aircraft-missile boresighting system as in claim 2 wherein said display means is a cathode-ray tube.

11. An aircraft-missile boresighting system as in claim 2 wherein said correlator means comprises:

means for averaging the signals representing the first sensor image so that its image resolution is degraded to the resolution level of the second sensor image; means for digitizing the signal representing each element making up the images sensed by both of said imaging means into a two-level binary code;

means for storing the digitized signals representing the first and second sensor images;

means for digitally comparing the array of stored elements representing the image sensed by said second sensor means with a set of equal sized arrays of elements taken from the larger image developed by said first imaging sensor means;

means for counting the number of digital "matches" determined by said comparison means for each array and determining the location of the area in the first sensor image which has the highest number of digital element "matches" with the second means image.

12. An aircraft missile boresighting system as in claim 11 wherein there are provided a plurality of missiles carried by said aircraft, each of said missiles containing said second imaging sensor means;

and further wherein said correlator means is modified so that said means for digitizing the signal and said means for storing the digitized signal may digitize and store images from a plurality of said second imaging sensor means simultaneously, and said means for digitally comparing the arrays of stored elements and said means for counting the number of digital "matches" are duplicated for every one of said second imaging sensor means boresights that is desired to be located within the first sensor image in said display means simultaneously.

13. An aircraft-missile guidance system for boresighting a small field-of-view missile sensor image to a large field-of-view aircraft sensor image comprising:

first imaging sensor means with a large field-of-view located in an aircraft;

second imaging sensor means with a much smaller field-of-view and low resolution relative to said first imaging sensor means located within a missile carried by the aircraft;

correlator means for determining the location of the second sensor field-of-view within the much larger first sensor field-of-view and calculating the boresight error between the two fields-of-view;

means for applying this calculated boresight error to the servo systems controlling the second imaging sensor boresight for effectively slaving said second imaging sensor means to the boresight of said first imaging sensor means.

14. An aircraft-missile guidance system for boresighting a small field-of-view missile sensor image to a larger field-of-view aircraft sensor image comprising:

first imaging sensor means with a large field-of-view located in an aircraft;

second imaging sensor means with a much smaller field of view and low resolution relative to said first imaging sensor means located within a missile carried by the aircraft;

correlator means for determining the location of the second sensor field-of-view within the much larger first sensor field-of-view and calculating the boresight error between the two fields-of-view;

means for applying this calculated boresight error to the servo systems controlling the first imaging sensor boresight for effectively slaving said first imaging sensor means to the boresight of said second imaging sensor means.

15. A guidance system for boresighting a plurality of small field-of-view imaging sensors within a large imaging sensor field-of-view comprising:

first imaging sensor means with a large field-of-view;

plurality of second imaging sensor means with fields-of-view substantially smaller than the field-of-view of said first imaging sensor means;

correlator means for determining the location of the plurality of second sensor fields-of-view within the larger first sensor field-of-view by digitally comparing the array of elements forming the image sensed by each of said plurality of second imaging sensor means with equal-sized arrays taken from the larger field-of-view image developed by said first sensor means such that a high correlation area within the image sensed by said first sensor means is determined for each of said plurality of second sensor means;

display means for displaying the image sensed by said first imaging sensor means;

means for applying the coordinates of these high correlation areas within the image sensed by said first sensor means to said display means to mark this area in the image displayed by said display means.

16. A guidance system for boresighting as in claim 15, wherein said correlator means comprises:

means for digitizing each element forming the images sensed by said imaging sensor means;

means for digitally comparing each array of elements forming the image sensed by said second sensor means with a set of equal-sized arrays of elements taken from the larger image developed by said first imaging sensor means; separate means for each of said second sensor means for counting the number of digital matches determined by said comparison means when comparing its array of image elements with different, equal-sized arrays taken from said first sensor means image and determining the area in the first sensor image which has the highest number of digital matches with this second sensor means image.

* * * * *